United States Patent [19]

Boeshart

[11] Patent Number: 4,889,310

[45] **Date of Patent: * Dec. 26, 1989**

[54] CONCRETE FORMING SYSTEM

[76] Inventor: Patrick E. Boeshart, R.R. 1, Box 134, Sioux City, Iowa 51108

[ * ] Notice: The portion of the term of this patent subsequent to Aug. 23, 2005 has been disclaimed.

[21] Appl. No.: 199,995

[22] Filed: May 26, 1988

[51] Int. Cl.[4] ..... E04G 11/06; E04B 2/84

[52] U.S. Cl. ..... 240/41; 52/98; 52/309.12; 52/426; 52/564; 249/44; 249/83; 249/134; 249/191; 249/214; 249/216; 249/219.2

[58] Field of Search ..... 249/38, 41, 44, 45, 249/47, 83, 134, 191, 192, 214, 216, 218, 219.2; 52/98–100, 309.12, 426–428, 562, 564

[56] References Cited

U.S. PATENT DOCUMENTS

| | | | |
|---|---|---|---|
| 994,027 | 5/1911 | O'Beirne | 52/564 |
| 1,126,190 | 1/1915 | Fuehrer | 249/214 |
| 2,181,698 | 11/1939 | Langenberg | 52/258 |
| 4,019,298 | 4/1977 | Johnson | 52/594 |
| 4,180,956 | 1/1980 | Gross | 52/407 |
| 4,223,501 | 9/1980 | DeLozier | 52/309.11 |
| 4,263,765 | 4/1981 | Maloney | 52/562 |
| 4,416,097 | 11/1983 | Weir | 52/220 |
| 4,439,967 | 4/1984 | Dielenberg | 52/309 |
| 4,604,843 | 8/1986 | Ott et al. | 52/426 |
| 4,655,014 | 4/1987 | Krecke | 52/426 |
| 4,698,947 | 10/1987 | McKay | 52/426 |
| 4,706,429 | 11/1987 | Young | 52/426 |
| 4,730,422 | 3/1988 | Young | 52/562 |
| 4,731,968 | 3/1988 | Obino | 52/426 |
| 4,765,109 | 8/1988 | Boeshart | 52/562 |

FOREIGN PATENT DOCUMENTS

| | | | |
|---|---|---|---|
| 547072 | 10/1957 | Canada | 249/217 |
| 924922 | 4/1973 | Canada | 52/426 |
| 826353 | 12/1952 | Fed. Rep. of Germany | 249/45 |
| 2310299 | 9/1974 | Fed. Rep. of Germany | 52/562 |
| 2162560 | 2/1986 | United Kingdom | 249/10 |

*Primary Examiner*—James Housel

*Attorney, Agent, or Firm*—Zarley, McKee, Thomte, Voorhees & Sease

[57] ABSTRACT

An concrete form system includes opposed polystyrene panels stacked to form a pair of parallel, spaced-apart walls, at least one of the walls having panels which are smooth on their inward surface. Tie slots are formed in the upper and lower edges of the panels and are spaced evenly such that slots in vertically abutting panels are aligned. The panels are horiziontally staggered to strengthen vertical joints. A single tie is utilized to interlock two vertically abutting panels in each wall. A special tie design is used with the smooth-faced panels to allow the panels to be removed after a concrete wall has been formed. Another embodiment of the tie design utilizes an enlarged outer paddle with a projecting rib which allows connection of vertical walers directly to the tie.

11 Claims, 7 Drawing Sheets

CONCRETE FORMING SYSTEM

TECHNICAL FIELD

The present invention relates generally to a new and improved concrete forming system, and more particularly to a concrete forming system which utilizes polystyrene panels which may be constructed utilizing wall ties to hold the panels in parallel relation, and which may be left as permanent insulation on the formed wall or removed to form an exposed concrete wall.

BACKGROUND OF THE INVENTION

While wall-forming systems have been in use for many years, a recent development in this industry is in the use of polystyrene panels as forms for poured concrete walls. After the concrete has hardened, the panels remain in place on the walls to serve as permanent insulation. One example of this recent development may be found in U.S. Pat. No. 4,706,429 entitled "Permanent Nonremovable Insulating Type Concrete Wall Forming Structure."

This new wall-forming system utilizes a system of "blocks," each block comprising a pair of polystyrene panels connected in parallel, spaced-apart alignment by a series of rigid synthetic plastic ties between the panels. Each panel has a series of T-shaped slots along its upper and lower edges, into which T-shaped ends on the plastic ties are inserted to "lock" the panels in spaced-apart relation. The upper and lower edges of the panels have castellations which further serve to lock the panels in vertical and horizontal relationship. The end edges of each panel have dovetail type tongue and groove joints to allow for slidable interconnection. The interior face of each of the panels is striated so as to allow modular end panels to be slidably located between the wall panels at any given location, and to promote adhesion between the panels and concrete.

Once concrete is poured between the panels, the concrete will adhere to the striations on the panels and hold the panel in place. Since the T-shaped ends of the ties do not extend completely through the panels, a smooth panel surface on the exterior of the wall could be finished as desired. It can be seen that the panels of the prior art provide a form for pouring the concrete, as well as insulating the wall once the concrete has hardened.

While this nonremovable insulated concrete form system has advantages over the prior art, the system is limited by the fact that the panels are permanently adhered to the concrete wall. Thus, such a system is not capable of use on those occasions where an exposed concrete surface is desired. On those occasions, it was necessary to revert to the older methods of wood form boards, steel bracing within the concrete, and extensive exterior bracing to hold the form boards in the appropriate alignment. Such a system is cumbersome, utilizes heavy material, and is difficult to utilize to produce accurately aligned walls. Furthermore, the materials of old methods of forming concrete walls must be moved from site to site, thereby requiring storage facilities.

A further problem with the prior art form systems is in the fact that each of the panels requires significant machining in order to create the tongue and groove portions, the striations, and the castellations in order to lock the panels together. This can significantly increase the cost of the panels because of time and material spent. Furthermore, use of castellations on the panels forms small portions which are easily broken off the panels during construction. This leaves unsightly holes and pockmarks in the face of the finished wall.

Another problem with prior art form systems is in the large number of ties which must be utilized in order to hold the panels in spaced-apart relationship. For instance, the system disclosed in U.S. Pat. No. 4,706,429 requires a series of ties spaced intermittently along both the top and bottom edges of every panel. Since the ties are not evenly spaced vertically and horizontally, conventionally dimensioned coverings are not conveniently attached to the ties through the panel surface.

A further problem with prior art concrete forming systems is in the fact that the height dimension of the panels limits the width of the wall which may be poured. Typically, conventional panels have a height of approximately 12 inches, and are useful in forming walls of less than 12 to 14 inches. Attempts to pour walls thicker than 14 inches result in bulging of the panels between the vertically spaced horizontal edges.

Finally, as mentioned above, prior art forming systems utilized panels which were permanently mounted to the wall. This was partly due to the system of incorporating the ties into each panel, and partially due to the specific configuration of the panels themselves. In any case, the option to be able to remove the panels from the wall is a much desired advantage, and was heretofore unknown.

It is therefore a general object of the present invention to provide an improved concrete wall forming system.

Another object of the present invention is to provide a wall form system including pairs of oppositely disposed polystyrene panels, at least one of the panels being removable from the wall once the wall has been formed.

Still another object of the present invention is to provide an improved tie for use in the concrete wall forming system of this invention.

Still another object is to provide polystyrene panels for an improved concrete forming system which do not require complex machining.

Yet another object of the present invention is to provide a wall form system capable of forming exceptionally thick walls.

A further object is to provide an improved wall form system in which panels may be removed and used again.

Still a further object of the present invention is to provide an improved wall tie for a wall forming system which will allow direct connection of walers.

Another object of the present invention is to provide an improved method for forming a poured concrete wall.

Yet another object is to provide a method for forming a concrete wall with at least one surface of the wall exposed.

These and other objects will be apparent to those skilled in the art.

SUMMARY OF THE INVENTION

The improved concrete forming system of this invention includes a series of opposed polystyrene panels stacked on top of one another to form a pair of parallel, spaced-apart walls, the panels forming at least one of the walls being smooth on their inward surface so as to prevent adhesion with concrete poured between the walls. Tie slots are formed in the upper and lower edges of the panels and are spaced evenly and identically on every panel so that the panels may be interchanged. A single tie is utilized to interlock two vertically abutting panels in each wall, each tie end being engaged between vertically abutting pair slots in the abutting edges of the panels. A conventional end panel formed of dimensional lumber or the like is utilized to retain concrete between the walls formed of panels and the opposite end panels.

A special tie is utilized in connection with panels that will be removed after a concrete wall has been formed. The ends of the tie have a pair of spaced-apart paddle members which retain the thickness of the panel therebetween. A pair of small-cross-section legs hold the paddles in spaced-apart relation, and a pair of diverging small-cross-section legs connect the paddle members to the elongated strap of the tie. Once the concrete wall has been formed, the outer paddle is removed by applying a sharp vertical blow thereto, thereby breaking the small-cross-section legs of the tie. Once the outer paddle is removed, the panel may be removed and a sharp vertical blow applied to the inner paddle to break the small-cross-sectional diverging legs of the tie. Thus, an exposed concrete surface may be produced using the special tie and method of this invention.

Another embodiment of the invention is designed to specifically allow use of portions of prior art systems. If it is desired to produce a concrete wall with one insulated surface and one exposed surface, the permanent non-removable wall-forming panels of the prior art may be utilized to form one wall of the oppositely disposed parallel walls of the form of this invention. Tie slots must then be cut in the present applicant's panels at spacings matching those of the prior art panels. The applicant's new tie design may be utilized in the T-shaped slots of the prior art non-removable panels, and may also be utilized in the applicant's removable-type panels. In order to allow use of prior art panels, it is necessary to form the panels with interlocking members on the top, bottom and side edges, since the ties do not interlock the panels.

Another embodiment of the tie design utilizes an enlarged outer paddle disposed outwardly of the outward face of the panels. A structural rib on the paddle provides strength to the paddle for use in panels having greater height dimensions. The rib also is utilized to connect vertical walers directly to the rib. Once the concrete wall has been formed it is possible to remove the enlarged outer paddle and the panels in the same manner as with the previously described tie member.

DESCRIPTION OF THE PREFERRED EMBODIMENT

Figure 1:
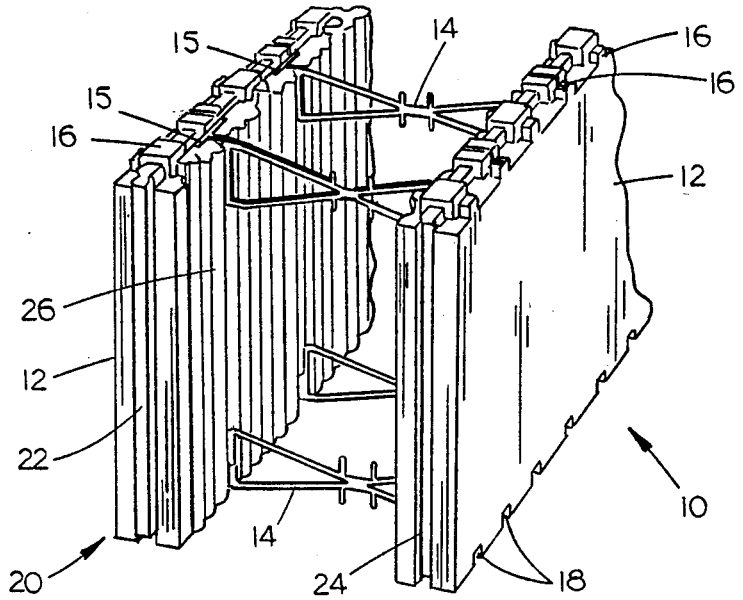
FIG. 1 (PRIOR ART)
FIG. 1 is a perspective view of a prior art forming system.

Referring now to the drawings, in which similar or corresponding parts are given the same reference numeral, and particularly to FIG. 1, wherein a concrete form system of the prior art is designated generally at 10, and includes a pair of opposed panels 12 of polystyrene connected in spaced relation by synthetic plastic ties 14 engaged in T-shaped slots 15. Panels 12 of the prior art form system are solid two inch panels of polystyrene which are approximately twelve inches high and twenty or forty inches long. Each panel 12 has male castellations 16 along its top edge and matching female castellations 18 along its under edge. A "block" 20 is composed of a pair of panels 12 fastened together with ties 14 inserted along both the top and bottom edges. The blocks 20 are placed one on top of the other and pressed together, the male and female castellations 16 and 18 interlocking the blocks 20 vertically The vertical ends of each panel 12 have a tongue 22 or groove 24 and may be interlocked as required.

Rib and groove striations 26 are cut into the inner face of each panel 12 and allow "closure panels" (not shown) to be inserted between the two panels 12 to form a four-sided form to retain concrete. Once concrete is poured between panels 12 to form a wall, the panels 12 will be permanently affixed to the wall to provide insulation.

The applicant has found many applications wherein at least one side of a poured concrete wall is desired to be exposed and not insulated as in the prior art. In such a case, it is clear that the prior art concrete form system is unworkable since the panels 12 are permanently affixed to the wall. For this reason, the applicant has devised a concrete form system which allows one or both sides of the concrete wall to be exposed. In order to provide an exposed wall surface, it is necessary to provide form panels which are removable once the wall has been poured and hardens. In order to provide for the removability of the panel, the applicant herein has provided a new tie which is presently the subject of co-pending patent application, Ser. No. 101,055, filed Sept. 25, 1987 entitled "Adjustable Tie", now U.S. Pat. No. 4,765,109. The disclosure of the co-pending application is incorporated herein by reference.

Figure 2:
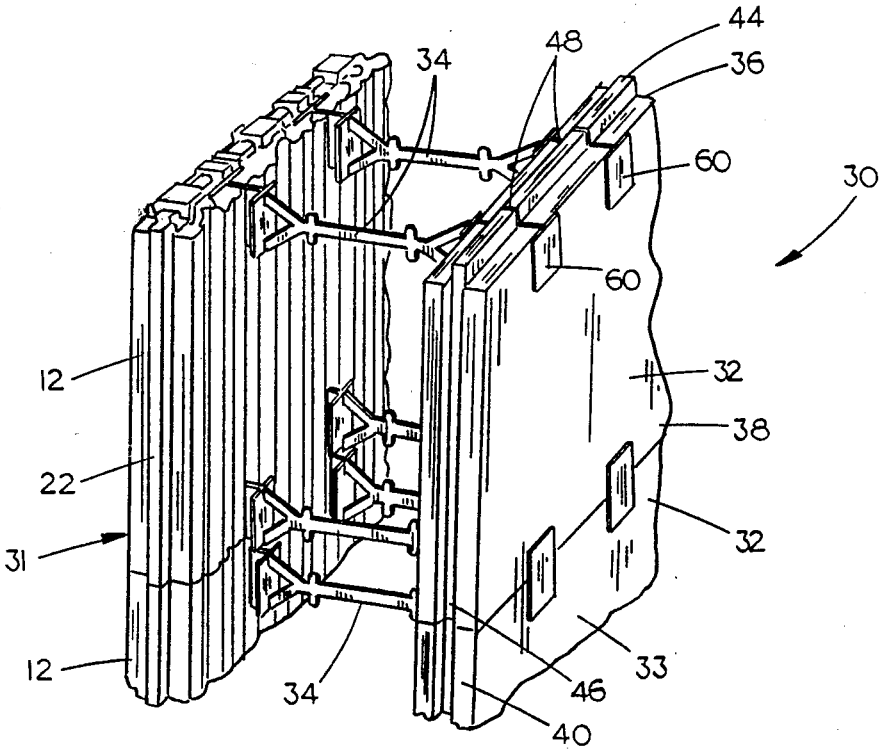
FIG. 2 is a perspective view of one embodiment of the inventor's new forming system used in conjunction with a panel from a prior art system.

Referring now to FIG. 2, one embodiment of the applicant's invention is shown generally at 30, combining panels 12 of the prior art with applicant's new panel 32 and new tie 34. In this case, a series of prior art panels 12 form one vertical wall 31 of form system 30, while a series of vertically and horizontally stacked panels 32 form the opposing, parallel wall 33 of form system 30. As will be described in more detail below, panels 32 of wall 33 may be removed from the concrete wall formed in form system 30, while panels 12 will remain permanently in place.

Each panel 32 has an upper edge 36, lower edge 38, and a pair of side edges 40 (one side edge is not shown). Each upper edge 36 and one side edge (not shown) as a tongue 44 (similar to tongue 22 on panel 12) centered therealong corresponding to a groove 46 centered in the lower edge 38 and other side edge 40 of an adjacent panel 32. It can be seen that this tongue and groove joint will interlock adjoining panels 32 both vertically and horizontally.

A series of slots 48 are cut downwardly in the upper edge 36 of each panel 32, and are modularly spaced therealong to be directly opposite slots 15 in panels 12. A second series of slots (not shown) are cut upwardly in the lower edge 38 of each panel 32, the lower slots being vertically aligned with upper slots 48. The slots are cut to a depth sufficient to receive the entire height of a tie 34, as seen in the drawings. In the embodiment shown in FIG. 2, each panel 32 is two inches thick, twelve inches in height and may be twenty or forty inches in length, so as to correspond with panels 12 of the prior art.

Figure 6:
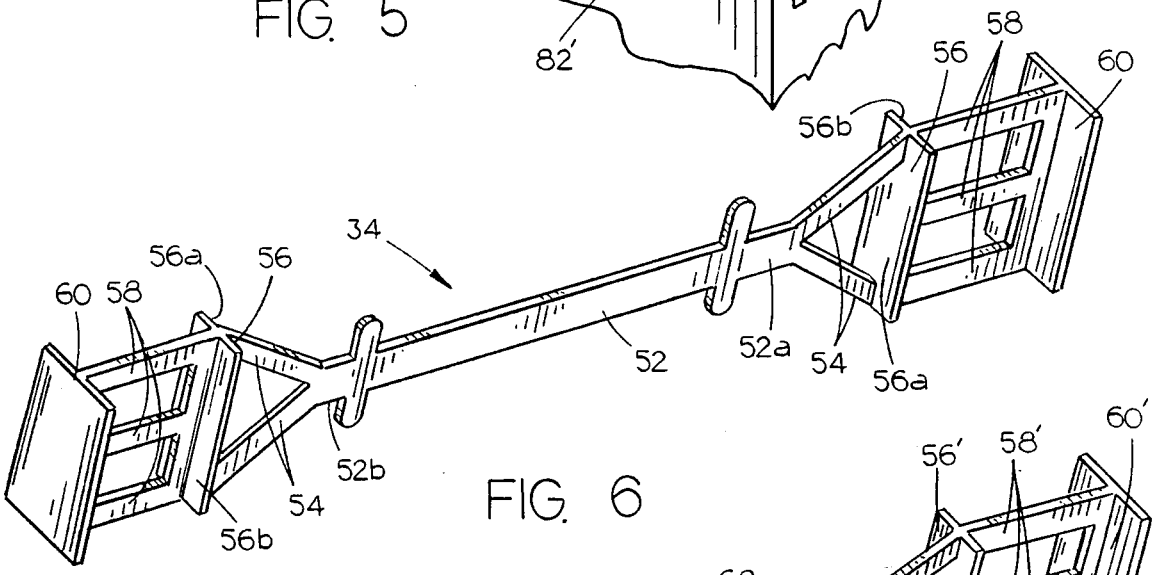
FIG. 6 is a perspective view of a tie utilized in the applicant's new forming system.
Figure 7:
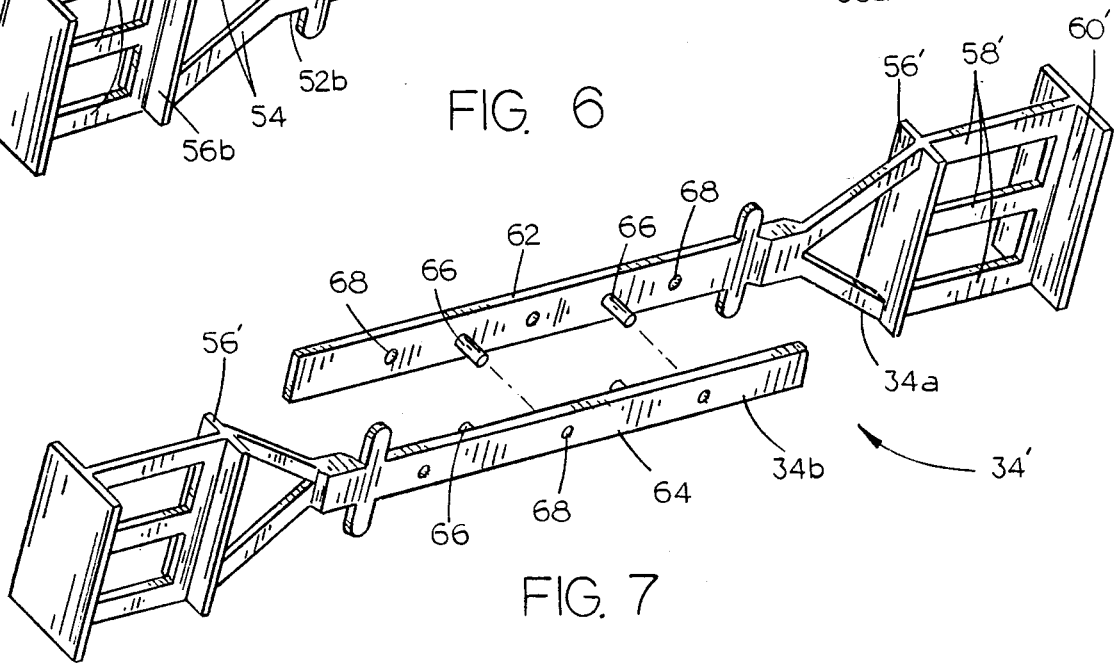
FIG. 7 is an exploded perspective view of a second version of a tie utilized in the applicant's new forming system.

Referring now to FIGS. 6 and 7, wall ties 34 and 34,, for use with applicant's form systems, are shown in more detail. The one-piece wall tie 34 shown in FIG. 6 includes an elongated strap 52 having a generally rectangular cross-section. At each end 52*a* and 52*b* a pair of diverging leg members 54 project outwardly and are affixed to an inner paddle member 56. Paddle 56 is a thin rectangular plate-like member oriented with its flat faces 56*a* and 56*b* perpendicular to the longitudinal axis of strap 52. As shown in FIG. 6, legs 54 are of small cross-section and form a generally equilateral triangular configuration in connection with paddle member 56. A set of three parallel and spaced-apart legs 58 project outwardly from the outer face 56*b* of each paddle 56, the legs being vertically aligned within the same plane as legs 54 and strap 52. Legs 58 extend from paddle 56 to an outer paddle 60, which is oriented parallel to inner paddle 56. Legs 58 and legs 54 are of substantially the same thickness and cross-section. The distance between paddle 56 and 60 is generally two inches, but may be adjusted for the particular thickness of panel upon which the tie 34 will be utilized.

Referring now to FIG. 7, a two piece tie 34′ is shown which has the same general characteristics as tie 34. Two piece tie 34′ utilizes a pair of corresponding and selectively connectable elongated straps 62 and 64, each strap having alternately spaced pegs 66 and apertures 68 which may be fastened to the corresponding apertures and pegs on the opposite strap 64. The straps may be connected in a variety of lengths such that the distance between the inner paddles 56′ may be varied. This in turn allows for the width of the concrete wall to be any thickness desired. Two piece tie 34′ also allows a wall to be poured around an existing pipe or conduit, since the opposing walls 31 and 33 may be connected together after being placed on opposite sides of the pipe, the tie halves 34*a* and 34*b* being connected by connecting straps 62 and 64 at the desired length.

While ties 34 and 34′ are shown with a set of three legs 58 and 58′ between inner and outer paddles 56 and 60, and 56′ and 60′, only the upper and lower legs are necessary for minimal functioning of the invention. The center leg is preferred, however, in order to strengthen the connection between the paddles, and prevent any twisting to occur between the inner and outer paddles. It is critical to note, however, that a solid web between inner and outer paddles 56 and 60 is unworkable. Similarly, legs 54 must diverge from strap 52 so that they are separated where they fasten to paddle 56. This is because paddles 60 and 56 will be removed by breaking them off from the remainder of the tie 34 or 34′ after the concrete wall has been poured. Use of a solid web makes it impossible to easily remove the paddles 56 and 60 as discussed hereinbelow.

Figure 13:
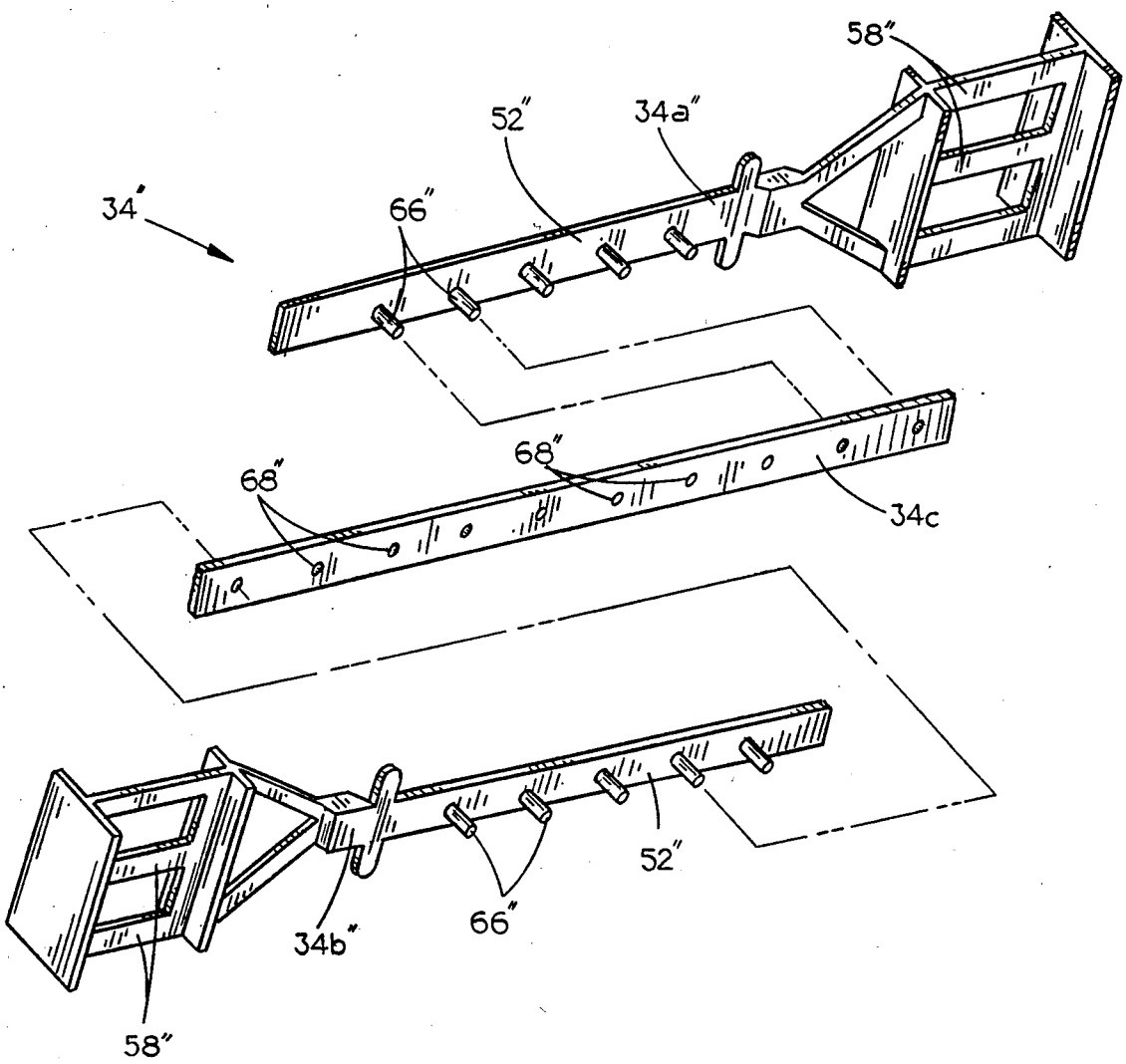
FIG. 13 is an exploded perspective view of another embodiment of the tie of this invention.

Another embodiment of a tie is shown in FIG. 13 and designated generally as 34″. Tie 34″ includes tie halves 34*a*″ and 34*b*″, which are identical to tie halves 34*a* and 34*b* of FIG. 7, except for the peg 66″ and aperture 68″ arrangement on strap portions 52″. Tie halves 34*a*″ and 34*b*″ are connected together with a center elongated strap 34*c*, and may be adjusted to a variety of lengths. It should be noted that both halves 34*a*″ and 34*b*″ are attached to the same side of center strap 34*c*, such that legs 58″ on each half 34*a*″ and 34*b*″ are aligned.

Figure 8:
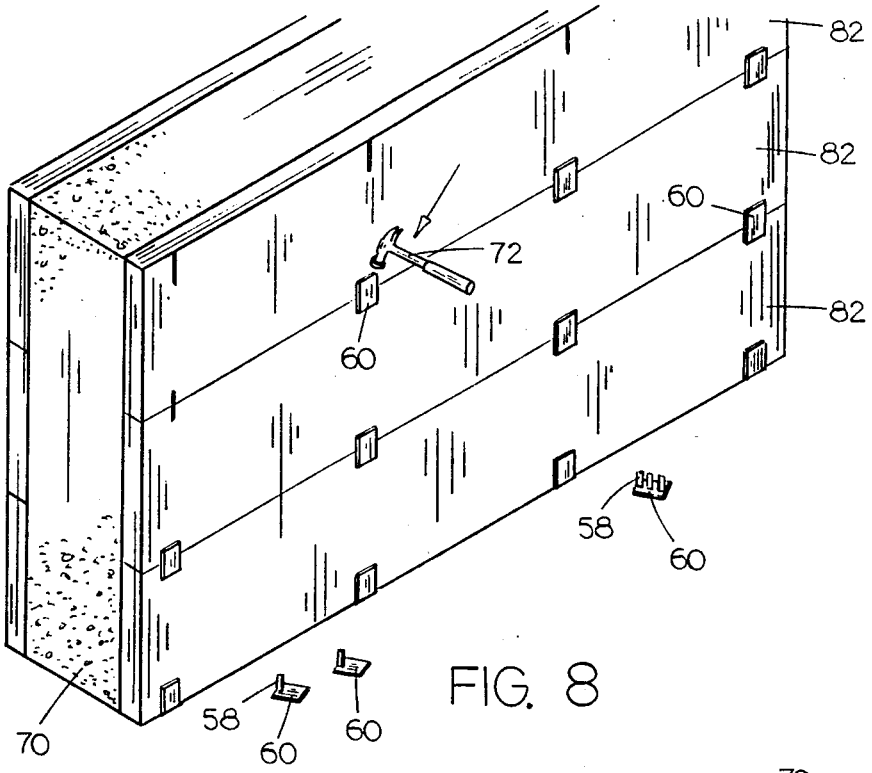
FIG. 8 is a perspective view of a wall with panels of the forming system thereon, showing how the outer paddle of a tie may be removed.
Figure 9:
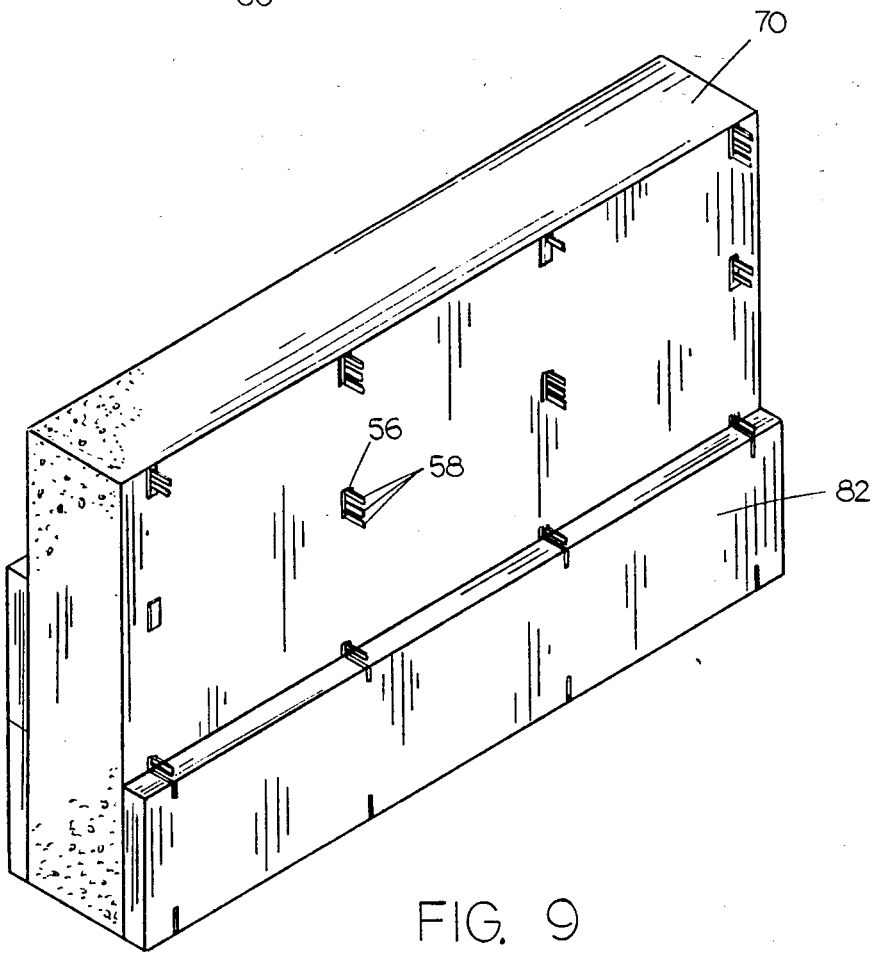
FIG. 9 is a perspective view of the wall of FIG. 8 with several panels removed therefrom.
Figure 10:
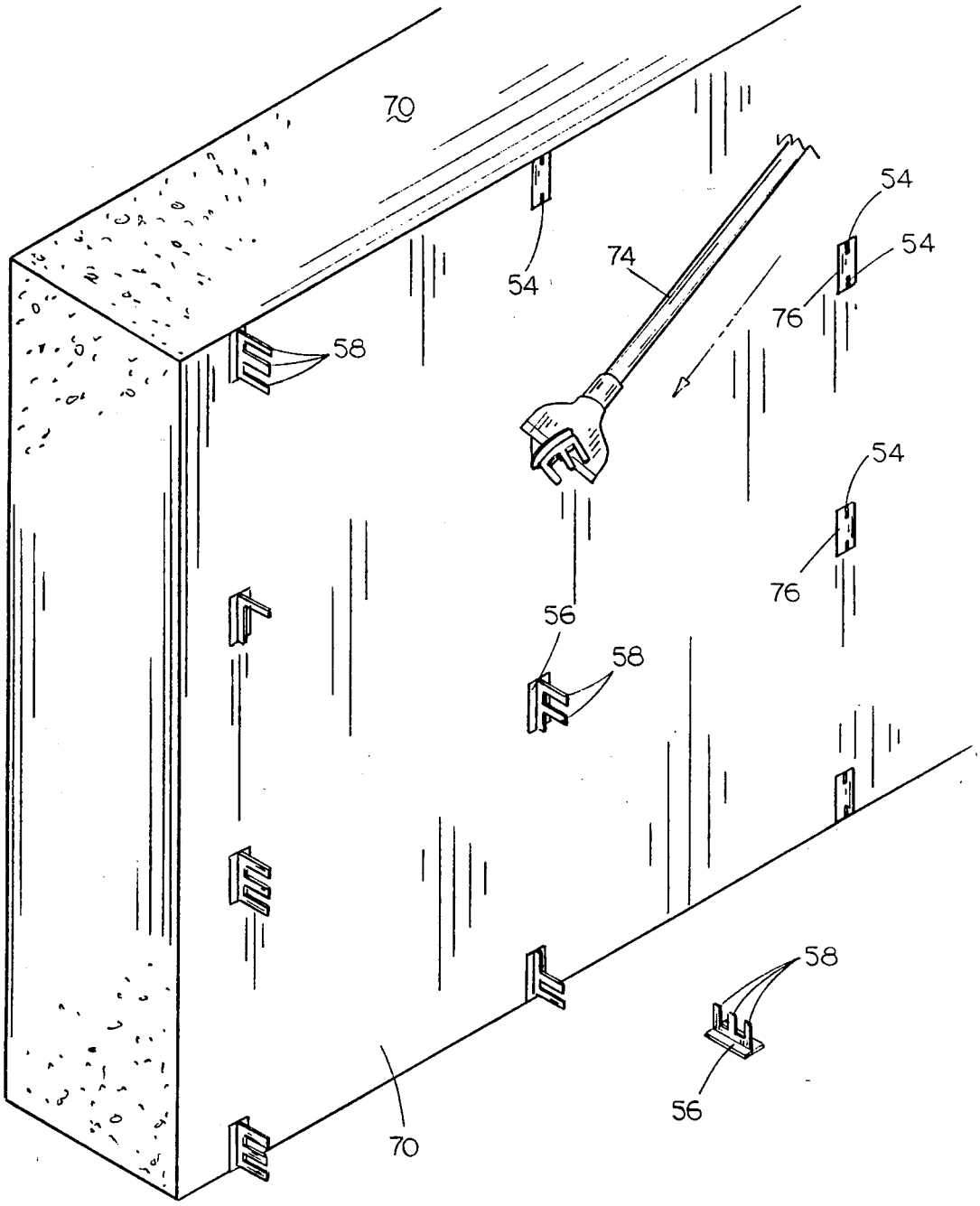
FIG. 10 is an enlarged perspective view of the wall of FIG. 8 with all panels removed, showing how the projecting ends of the ties may be removed.

Referring now to FIGS. 8 through 10, the sequence of drawings shows how the panels may be removed from a hardened concrete wall 70 so as to leave the wall 70 exposed. While panels 82 in FIG. 8 have the configuration of those shown in the embodiment of FIG. 3, the method for removing panels 82 is the same as with panels 32. FIG. 8 shows how a hammer 72 is used to apply a sharp vertical blow to the outer paddle 60 which is exposed on the outside surface of each panel 82. Because of the small cross-section of legs 58, and the use of a plastic material, legs 58 will readily break, allowing paddles 60 to fall to the ground. Once outer paddles 60 are removed from one entire panel 82, panel 82 may be pulled outwardly away from the wall 70 and removed.

FIG. 9 shows concrete wall 70 with a number of panels 82 removed, leaving inner paddles 56 and portions of broken legs 58 projecting outwardly therefrom. Because panels 82 have a smooth inner surface, they do not adhere to concrete wall 70 and are easily removed. FIG. 10 shows how a conventional scraper 74 may be used quickly and efficiently to knock off the remaining portion of the exposed tie—namely, legs 58 and inner paddle 56. Scraper 74 is utilized to apply a sharp blow to legs 58 which breaks the tie at the ends of diverging legs 54 (see FIG. 6) such that legs 58 and inner paddle 56 fall to the ground. Once removed, small indentations 76 are left in the wall surface with only a cross-section of legs 54 seen. Each indentation 76 may be quickly and easily filled with concrete so as to leave a smooth wall surface, if so desired.

It can therefore be seen that it is critical that legs 54 and legs 58 be of small cross-section and of a "breakable" material, such as plastic, such that a sharp blow will cause a fracture to occur in legs 54 or 58 so as to remove the paddles 56 and 60. It is further necessary that panels 82 have a smooth interior face so as to allow ease of removal of the panel from the concrete wall 70. Use of a striated face 26 as shown in FIG. 1 of the prior art, would prevent removal of the panel 12.

Figure 3:
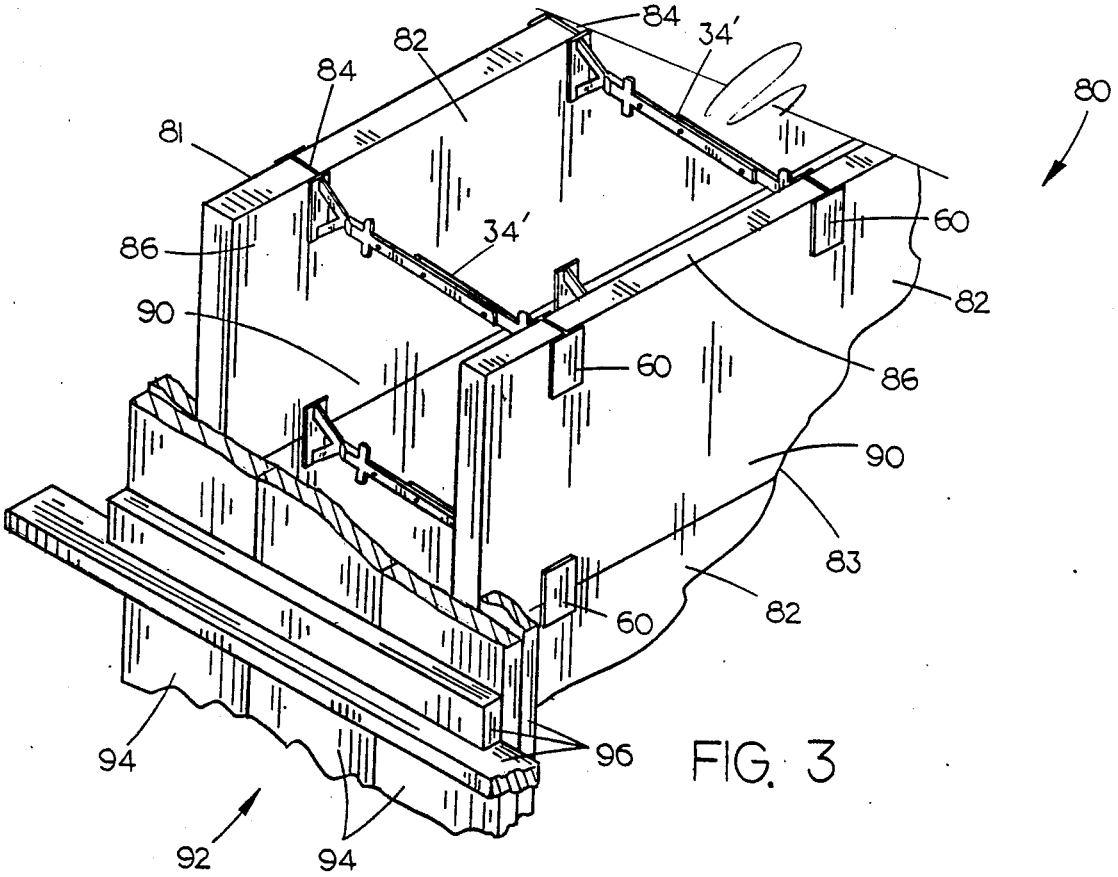
FIG. 3 is a perspective view of a second embodiment of the applicant's new forming system.

Referring now to FIG. 3, a second embodiment of the concrete forming system is designated generally at 80, and includes a pair of parallel vertical walls 81 and 83, composed of oppositely disposed polystyrene panels 82 having smooth inner and outer faces. The applicant has discovered that reducing the height of panels 82 to approximately eight inches provides heretofore unrealized advantages over the prior art. The panels 82 are still preferably two inches in thickness and may be of any standard length, but slots 84 along the upper edge 86, and slots (shown in FIG. 4 as 84' and 88') in the lower edge 80 of each panel 82 are spaced horizontally at eight inch intervals, such that ties 34' are evenly spaced in both vertical and horizontal arrangement. Slots 84 and 88 are preferably located beginning four inches from each vertical edge of panels 82, so that two horizontally-abutted panels 82 will maintain the even eight inch spacing.

The vertical joints formed between horizontally-abutting panels 82 are staggered so as to strengthen the wall. Since slots 84 are spaced at equal intervals, staggering the vertical joints still allows the same tie spacing and alignment.

In some cases, it may be desirable to locate a tie directly on a vertical joint, so as to strengthen the joint against the outward pressure of the concrete. This may be accomplished by showing half the thickness of a slot 84 on each vertical edge of panels 82. This allows the vertical edges of the panels 82 to form a tightly abutting vertical joint. The horizontal spacing of the slots 84 would still be maintained at eight inches, to maintain the modular arrangement of ties.

The applicant has further discovered that the tongue and grooves shown in FIG. 2 and the castellations shown in FIG. 1 are not necessary to provide a strong interlocking system. Rather, the applicant has cut a slot one-half the depth of the tie end in each panel upper edge 86 and lower edge 90 such that one-half of the tie ends will rest in each of the abutting slots 84 (lower slot not being seen in FIG. 3). Thus, a single tie interlocks a vertically abutting pair of panels in vertical relationship and also maintains the horizontal alignment of the panels 82 by virtue of the tight grip of paddles 56 and 60. The use of eight inch high panels along with eight inch horizontal spacing of the ties dramatically reduces the number of ties utilized to form a concrete wall as compared with the prior art system of FIG. 1. In fact, it has been found that the number of ties for a comparable wall is reduced by nearly fifty percent. Another advantage in using eight inch spacing is in the fact that normal four foot by eight foot sheets of material may be easily attached to the exposed paddles 60 without attempting to find ties that are appropriately spaced, which was necessary in the prior art. Since it is no longer necessary to machine each panel with a tongue and groove arrangement or castellations, or the like, the cost of the panel materials is also dramatically reduced. Common materials already available may be quickly and efficiently cut to the dimensions preferred without special tools for tongue and groove joints and the like.

Use of an eight-inch-high panel has also proved to be extremely advantageous in allowing for a variety of wall thicknesses. The inventor has successfully poured eighteen inch thick walls utilizing the system disclosed in FIG. 3. A similar attempt with the inventor's tie fitted into the twelve inch height panels of the prior art failed. The twelve inch panels failed along a horizontal line centered between the top and bottom edges of the panel. This dramatic success allows for great versatility in the use of the concrete forming system of this invention.

As shown in FIG. 3, the uppermost horizontal tier of panels have slots 84 which are cut to a depth equal to the height of tie 34'. This allows tie 34' to be inserted for a flush upper edge 86. A similar "full depth" slot is cut into the lower edge of the lowermost horizontal tier of panels, so that a flush bottom edge will allow the form system to rest flush on the ground surface.

FIG. 3 also shows an end panel 92 created from three vertically-oriented 2×12 boards 94 fashioned together with scrap lumber 96 as seen in the drawings. End panel 92 may be held in place against the vertical end of walls 81 and 83 in any conventional fashion. End panel 92 thus retains poured concrete between walls 81 and between end panels 92 at each end. The inventor has also found that an extra piece of polystyrene may be cut to a width equal to the distance between the vertical walls formed by panels 82. This extra piece may be inserted vertically so as to rest against the vertically-aligned ties 34', to thereby form an end panel. Once the concrete has hardened this end panel is removed after removing panels 82. Of course, the projecting ends of the vertical panels may also be cut flush to the concrete wall if the panels 82 are to be left in place.

Figure 4:
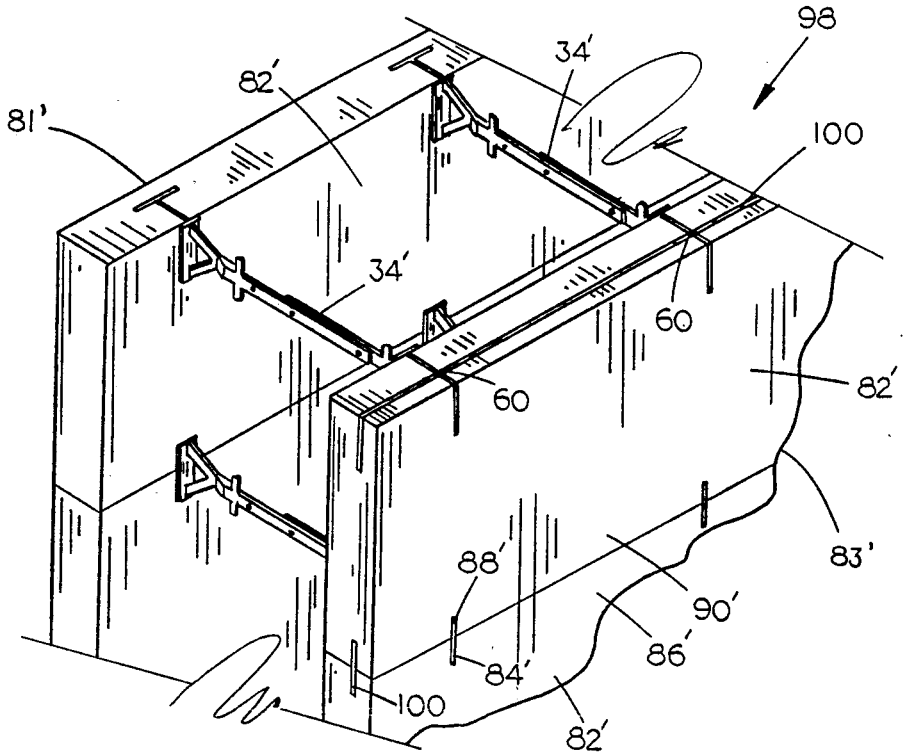
FIG. 4 is a third embodiment of the applicant's new forming system.
Figure 5:
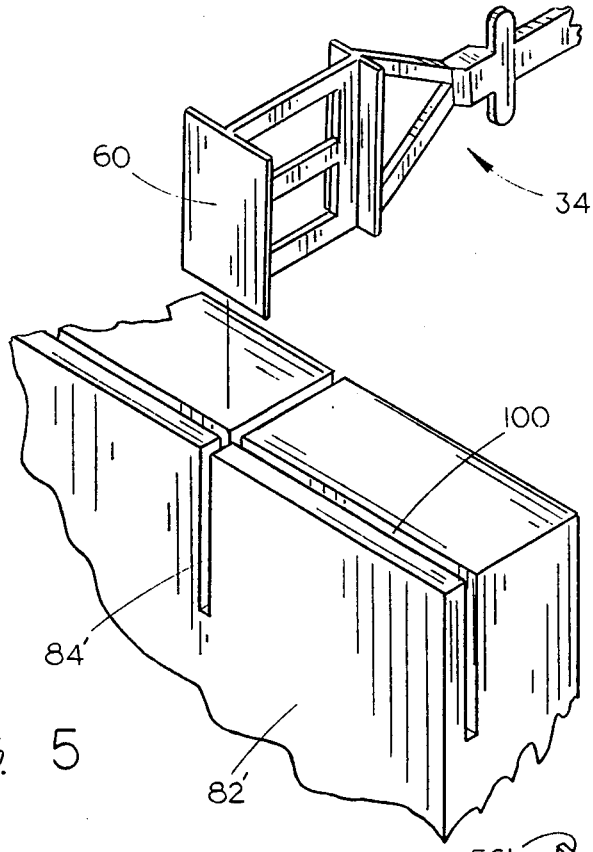
FIG. 5 is an enlarged perspective view showing the connection of one tie end to a panel of the form system disclosed in FIG. 4.

Referring now to FIG. 4, a third embodiment of the form system of this invention is designated generally at 98. Form system 98 includes a pair of parallel walls 81' and 83', composed of pairs of opposingly disposed panels 82' secured in spaced-apart parallel relationship by ties 34'. Form system 98 is intended to remain in place on the concrete wall once the wall has been poured and hardened, similar to the prior art systems. In order to create an exterior surface which does not have the protruding paddle 60, common in the embodiments shown in FIGS. 2 and 3, an additional longitudinal slot 100 is cut along the entire length of panel 82' along the upper and lower edges 86' and 90', respectively. Slots 100 are cut to the same depth as slots 84' and 88'. The crossed-slot formed thereby will allow paddle 60 to slide downwardly within slot 100 such that the outer surface of panels 82' are unobstructed by paddles 60. FIG. 5 shows an enlarged portion of one panel 82' and how tie 34 may be inserted within slots 84' and 100. As shown in FIG. 4, the outer surface of panels 82' is only broken by the narrow empty slots 84' and 88'. These slots may be easily filled to provide a completely smooth surface, if so desired.

Although somewhat more time-consuming, individual T-shaped slots may be cut into each panel 82'. These T-shaped slots would be formed by a series of longitudinal cuts intersecting a series of transverse cuts, similar to those in the prior art. The individual T-shaped slots would avoid the necessity of filling the narrow empty slots shown in FIG. 4.

The embodiment of FIG. 4 may also be modified so as to provide a tie directly on the vertical joints formed between pairs of horizontally abutting panels 82'. If a longitudinal slot 100 is utilized, it is only necessary to shave one-half the thickness of a slot 84' and 88' from the upper and lower locations on the vertical edges of the panels 82'. In the case where each T-shaped slot is formed individually, one-half of the longitudinal cut is formed in each vertical edge. The horizontal spacing of the ties would remain at eight inches, to maintain the modular arrangement of the ties.

Figure 11:
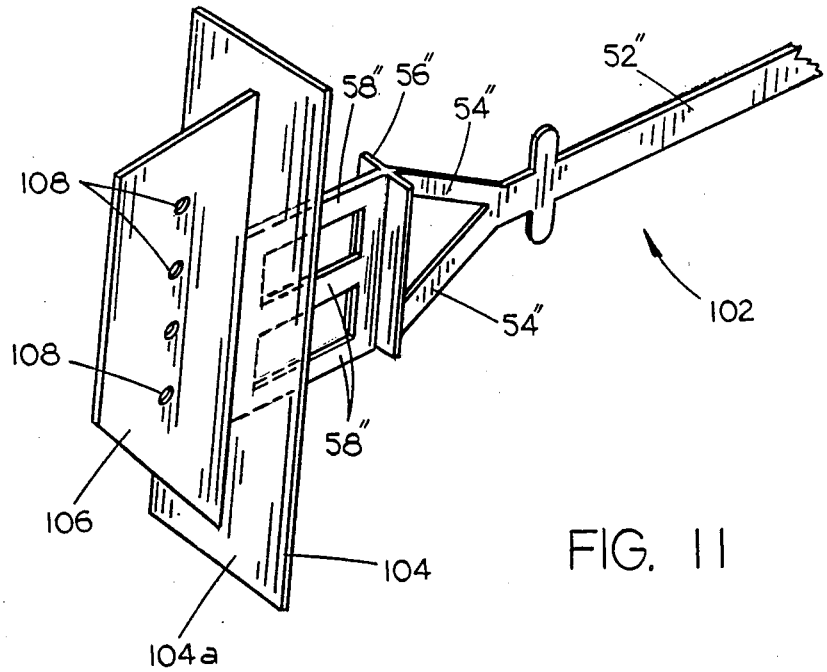
FIG. 11 is a perspective view of a third embodiment of the tie of the present invention.

Referring now to FIG. 11, a third embodiment of a tie is designated generally at 102. Tie 102 includes the same elongated strap 52'', diverging leg members 54'', inner paddle 56'' and legs 58'' as the tie 34 shown in FIG. 6. The main difference is in the use of an enlarged outer paddle 104 in place of the outer paddle 60 shown in FIG. 6. Enlarged outer paddle 104 has a width of about two inches and a height of about six inches and has a rib 106 projecting perpendicularly from the outer face 104*a*, as shown in the drawing. Rib 106 is generally trapezoidal in shape with the base of the trapezoid located along the longitudinal center line of outer paddle surface 104*a*. Rib 106 also has a series of apertures 108 spaced along a line parallel to paddle 104 and generally centered along rib 106. Apertures 108 may be used to attach a vertical waler 110 to tie 102 once placed on a wall structure 70″ as shown in FIG. 12.

Tie 102 was designed specifically to be used in conjunction with panels 112 which are twelve inches in height rather than the eight inch height of the panels of FIGS. 3 and 4 disclosed hereinabove. Tie 102 allows the ties to be spaced horizontally eight inches apart, the same as the embodiments shown in FIGS. 3 and 4, and also allows the use of a single tie to join two vertically abutting panel edges. Rib 106 provides the additional strength to outer paddle 104*a* to hold an additional vertical portion of each panel 112 against the strain of concrete poured therein. It has been found that the enlarged outer paddle 104 in conjunction with the remainder of a typical tie, as shown in FIG. 11, is sufficient to withstand the additional pressures exerted upon twelve inch panels in forming extra wide concrete walls.

Figure 12:
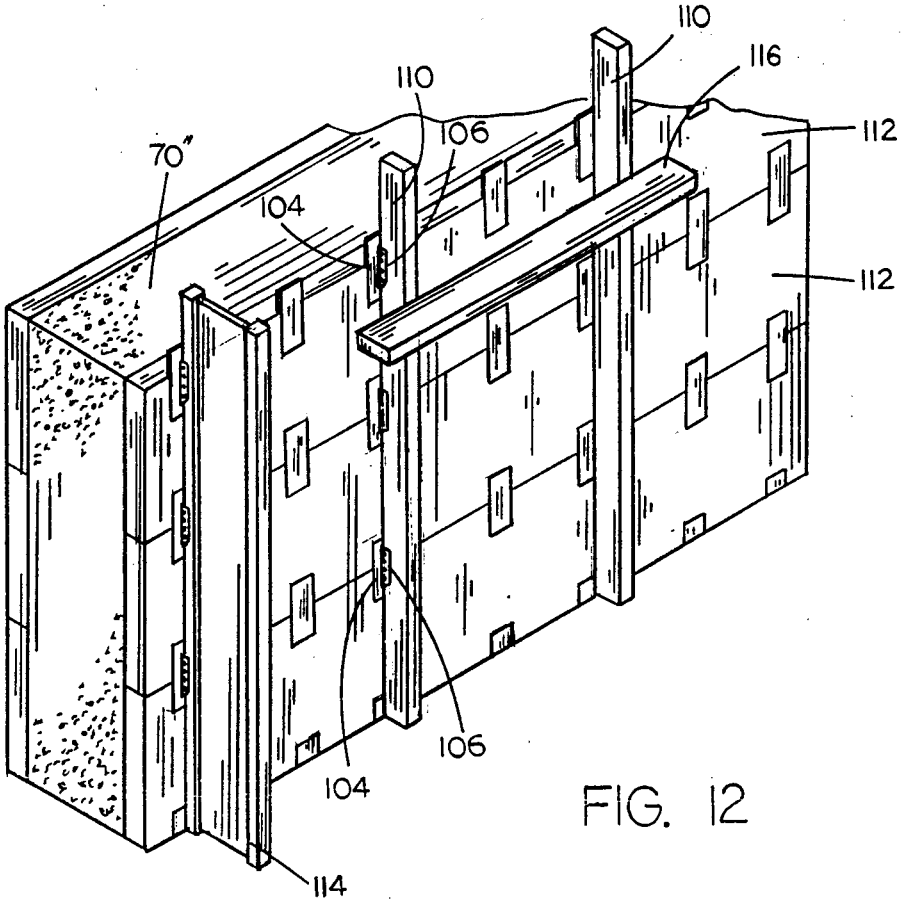
FIG. 12 is a perspective view of a wall form system using the tie of FIG. 11.

Referring to FIG. 12, a wall 70″ is shown with panels 112 affixed thereto utilizing tie 102. A pair of 2″∴4″ vertical walers 110 are fastened to vertically-aligned ribs 106 using nails or screws affixed through apertures 108 into the walers 110. A trust joist 114 may also be utilized as a vertical waler, as shown in the drawing. A horizontal waler 116 may be fastened to vertical walers 110 to provide horizontal alignment.

It can therefore be seen that at least all of the above stated objectives are fulfilled by the above-described invention.

I claim:

1. An improved concrete forming system, comprising:

a series of opposed first and second polystyrene panels connected in opposed, parallel, spaced-apart relationship;

said first panels stacked on top of one another and also disposed in end-to-end relationship;

said second panels stacked on top of one another and also disposed in end-to-end relationship;

said first and second panels having an inwardly-disposed surface, an outwardly-disposed surface, upper and lower edges, and vertical side edges;

said first panels having a smooth inwardly disposed surface for resisting adhesion to concrete poured between said first and second panels;

said first panels having means on their upper and lower edges and opposite vertical edges for interlocking identical first panels in engagement with one another;

said second panels having means on their upper and lower edges and opposite vertical edges for interlocking identical second panels in engagement with one another;

tie slots in said first and second panels positioned in longitudinally spaced rows along said upper and lower edges;

synthetic plastic ties arranged in vertically-spaced horizontally-extending rows and having opposite tie ends engaged in said tie slots;

said ties including an elongated strap having a pair of diverging legs at each end;

each said tie end having an inner and an outer paddle-member in spaced-apart, parallel, relation and connected by at least two leg members, said inner and outer paddle members spaced a distance apart to retain the thickness of a panel therebetween, said paddle members being oriented perpendicular to said elongated strap;

said tie slots in said second panel being in the shape of a "T", and the outer paddle and leg members of said ties also forming a "T" shape, so that either tie end may be retainingly engaged in the T-shaped tie slots of said second panels;

said tie slots in said first panels being straight and cut completely through the thickness thereof, so that the inner and outer paddle of a tie end will retain the panel thickness therebetween and the tie leg members will be engaged in said tie slot;

said tie slots in said first and second panels being positioned directly opposite each other along upper and lower edges and in equidistant longitudinal arrangement such that said first panels can be interchanged with one another, said second panels can be interchanged with one another, and said first and second panels will have directly oppositely disposed tie slots;

end panel means for retaining concrete between said panels and said end panels;

said tie ends in said second panels being permanently secured in embedded position in said panels to permanently retain said second panels in position when concrete is poured and hardened between said first and second panels to thus provide an insulated concrete wall with synthetic plastic panels permanently attached to the exterior of one side of said wall;

said outer paddle of said tie ends in said first panels being disposed outwardly of said panels, said legs between said inner and outer paddles being of a material adapted to be easily broken by a sharp vertical blow to said outer paddle, such that said first panels may be removed from a hardened concrete wall formed between said first and second panels, said diverging legs of said tie being of a material adapted to be easily broken by a sharp vertical blow to said inner paddle, such that the hardened concrete wall formed between said first and second panels may be exposed by removing said outer paddle, said first panel, and said inner paddle.

2. A concrete forming system, comprising:

a pair of parallel walls, each comprised of a series of polystyrene panels stacked on top of one another;

said panels having an inwardly disposed surface, an outwardly disposed surface, upper and lower edges, and vertical opposite side edges, vertical tie slots in said upper and lower edges of said first and second panels, spaced equidistant horizontally on every panel such that vertically abutting panels have slots which abut in vertical alignment;

tie means engaged in said tie slots for interlocking vertically abutting panels in vertical engagement with one another and for interlocking opposingly disposed panels of said parallel walls in parallel, spaced-apart relation; and each said tie means including: an elongated strap having a pair of diverging legs at each end;

said diverging legs at each end of said strap having an inner and outer paddle member connected thereto;

said inner and outer paddle members mounted perpendicularly to said strap; and at least two leg members mounted between said inner and outer paddle members at each strap end, affixing said inner and outer paddles in spaced-apart, parallel relation at a distance to retain a panel thickness therebetween.

3. A concrete forming system, comprising:

first and second parallel and spaced-apart walls;

said first wall comprised of a series of first polystyrene panels stacked on top of one another;

said second wall comprised of a series of second polystyrene panels stacked on top of one another;

said first and second panels having an inwardly-disposed surface, an outwardly-disposed surface, upper and lower edges, and vertical side edges;

vertical tie slots in said upper and lower edges of said first and second panels, spaced equidistant horizontally on every panel such that vertically abutting panels have slots which abut in vertical alignment;

tie means engaged in said tie slots for interlocking vertically abutting panels in vertical engagement with one another and for interlocking said first panels in said first wall with said second panels in said second wall in parallel, spaced-apart relation;

end panel means at each end of said parallel walls for retaining concrete between said walls and said end panels for forming a concrete wall;

said tie slots in said panels being single vertical slots cut completely through the thickness of said panels perpendicularly to the inner and outer surfaces;

said tie means having ends for engagement with said slots;

said slots being cut to a vertical depth equal to one-half the vertical height of the ends of said tie means, such that said tie ends completely fill the vertical depth of abutting slots in vertically abutting panels, interlocking the same;

said slots in the lower edge of the lowermost tier of panels in said walls being cut to a vertical depth equal to the vertical height of the ends of said tie means; and said slots in the upper edge of the uppermost tier of panels in said walls being cut to a vertical depth equal to the vertical height of the ends of said tie means;

said tie end completely filling the vertical depth of said slots in the lower edge of the lowermost tier of panels and said slots in the upper edge of the uppermost tier of panels, such that said lower and upper edges are free of protruding ties;

each said tie means including:

an elongated strap having a pair of diverging legs at each end;

said diverging legs at each end of said strap having an inner and outer paddle member connected thereto;

said inner and outer paddle members mounted perpendicularly to said strap;

and at least two leg members mounted between said inner and outer paddle members at each strap end, affixing said inner and outer paddles in spaced-apart, parallel relation at a distance to retain a panel thickness therebetween.

4. A concrete forming system comprising, a pair of parallel walls, each comprised of a series of polystyrene panels stacked on top of one another;

said panels having an inwardly disposed surface, an outwardly disposed surface, upper and lower edges, and vertical opposite side edges;

vertical tie slots in said upper and lower edges of said first and second panels, spaced equidistant horizontally on every panel such that vertically abutting panels have slots which abut in vertical alignment;

tie means engaged in said tie slots for interlocking vertically abutting panels in vertical engagement with one another and for interlocking opposingly disposed panels of said parallel walls in parallel, spaced-apart relation; and each said tie means including:

an elongated strap having a pair of diverging legs at each end;

said diverging legs at each end of said strap having an inner and outer paddle member connected thereto;

said inner and outer paddle members mounted perpendicularly to said strap; and at least two leg members mounted between said inner and outer paddle members at each strap end, affixing said inner and outer paddles in spaced-apart, parallel relation at a distance to retain a panel thickness therebetween; and wherein said outer paddle members are enlarged to have a vertical height more than twice the height of said inner paddle members and a width approximately twice the width of said inner paddle members, the thickness of said outer paddle members being substantially the same as said inner paddle members, said outer paddles further comprising a vertically-oriented rib projecting outwardly perpendicularly therefrom, said rib adapted to provide structural support to said outer paddle to prevent bending about a horizontal axis within the plane of the paddle.

5. The concrete forming system of claim 4, wherein said ribs are further characterized as having at least one aperture therethrough for affixing vertical walers between vertically aligned ribs.

6. A concrete forming system, comprising:

a pair of parallel walls, each comprised of a series of polystyrene panels stacked on top of one another;

said panels having an inwardly disposed surface, an outwardly disposed surface, upper and lower edges, and vertical opposite side edges;

said panels having a smooth inwardly disposed surface for resisting adhesion to concrete poured between said panels;

vertical tie slots in said upper and lower edges of said panels, spaced equidistant horizontally on every panel such that vertically abutting panels have slots which abut in vertical alignment;

a plurality of independent, elongated tie means each having first and second longitudinal ends, each of said end being engaged in a pair of said vertically abutting tie slots for interlocking vertically abutting panels in vertical engagement with one another and for interlocking opposingly disposed panels of said parallel walls in parallel, spaced-apart relation, said tie means being spaced-apart vertically and horizontally;

each said tie means including:

an elongated strap having a pair of diverging legs at each end;

said diverging legs at each end of said strap having an inner and outer paddle member connected thereto;

said inner and outer paddle members mounted perpendicularly to said strap; and at least two leg members mounted between said inner and outer paddle members at each strap end, affixing said inner and outer paddle members at each strap end in spaced-apart, parallel relation at a distance to retain a panel thickness therebetween; and end panel means at each end of said parallel walls for retaining concrete between said walls and said end panels, for forming a concrete wall.

7. The concrete forming system of claim 6, wherein said tie ends are mounted in said tie slots between vertically abutting panels with said outer paddle disposed outwardly of the outer surface of said panels, said inner paddle disposed inwardly of the inner surface of said panels, at least one leg between said paddles being retained in a slot in the lower edge of an upper, vertically abutting panel and at least one leg between said paddles being retained in a slot in the upper edge of a lower, vertically abutting panel, to interlock said vertically abutting panels;

said legs between said inner and outer paddles being of a material adapted to be easily broken by a sharp vertical blow to said outer paddle, such that said panels may be removed from a hardened concrete wall formed between said vertical walls, said diverging legs of said tie being of a material adapted to be easily broken by a sharp vertical blow to said inner paddle, such that the hardened concrete wall formed between said vertical parallel walls may be exposed by removing said outer paddle, said panels, and said inner paddles.

8. A concrete forming system, comprising:

first and second parallel and spaced-apart walls;

said first wall comprised of a series of first polystyrene panels stacked on top of one another;

said second wall comprised of a series of second polystyrene panels stacked on top of one another;

said first and second panels having an inwardly-disposed surface, an outwardly-disposed surface, upper and lower edges, and vertical side edges;

vertical tie slots in said upper and lower edges of said first and second panels, spaced equidistant horizontally on every panel such that vertically abutting panels have slots which abut in vertical alignment;

a plurality of independent, elongated tie means each having first and second longitudinal ends, each said end being engaged in a pair of said vertically abutting tie slots for interlocking vertically abutting panels in vertical engagement with one another and for interlocking said first panels in said first wall with said second panels in said second wall in parallel, spaced-apart relation, said tie means being spaced-apart vertically and horizontally;

said tie slots in said panels being single vertical slots cut completely through the thickness of said panels perpendicularly to the inner and outer surfaces such that said tie ends extend completely therethrough;

said tie ends engaged with said slots;

each said tie means including:

an elongated strap having a pair of diverging legs at each end;

said diverging legs at each end of said strap having an inner and outer paddle member connected thereto;

said inner and outer paddle members mounted perpendicularly to said strap;

and at least two leg members mounted between said inner and outer paddle members at each strap end, affixing said inner and outer paddles in spaced-apart, parallel relation at a distance to retain a panel thickness therebetween;

said slots being cut to a vertical depth equal to one-half the vertical height of the ends of said tie means, such that said tie ends completely fill the vertical depth of abutting slots in vertically abutting panels, thereby interlocking the panels;

said slots in the lower edge of the lowermost tier of panels in said walls being cut to a vertical depth equal to the vertical height of the ends of said tie means;

said slots in the upper edge of the uppermost tier of panels in said walls being cut to a vertical depth equal to the vertical height of the ends of said tie means;

said tie ends completely filling the vertical depth of said slots in the lower edge of the lowermost tier of panels and said slots in the upper edge of the uppermost tier of panels, such that said lower and upper edges are free of protruding ties;

at least said second panels being further characterized as having longitudinal slots cut along said upper and lower edges and intersecting said tie slots to form cross-slots at each said tie slot, the longitudinal slots being cut to the same vertical depth as said tie slots to which said longitudinal slots intersect, and wherein at least said first panels having a smooth inwardly disposed surface for resisting adhesion to concrete poured between said first and second walls; and end panel means at each end of said parallel walls for retaining concrete between said walls and said end panels for forming a concrete wall.

9. A concrete forming system, comprising:

first and second parallel and spaced-apart walls;

said first wall comprised of a series of first polystyrene panels stacked on top of one another;

said second wall comprised of a series of second polystyrene panels stacked on top of one another;

said first and second panels having an inwardly-disposed surface, an outwardly-disposed surface, upper and lower edges, and vertical side edges;

vertical tie slots in said upper and lower edges of said first and second panels, spaced equidistant horizontally on every panel such that vertically abutting panels have slots which abut in vertical alignment;

a plurality of independent, elongated tie means each having first and second longitudinal ends, each said end being engaged in a pair of said vertically abutting tie slots for interlocking vertically abutting panels in vertical engagement with one another and for interlocking said first panels in said first wall with said second panels in said second wall in parallel, spaced-apart relation, said tie means being spaced-apart vertically and horizontally;

said tie slots in said panels being single vertical slots cut completely through the thickness of said panels perpendicularly to the inner and outer surfaces such that said tie ends extend completely therethrough;

said tie ends engaged with said slots;

each said tie means including:

an elongated strap having a pair of diverging legs at each end;

said diverging legs at each end of said strap having an inner and outer paddle member connected thereto;

said inner and outer paddle members mounted perpendicularly to said strap;

and at least two leg members mounted between said inner and outer paddle members at each strap end, affixing said inner and outer paddles in spaced-apart, parallel relation at a distance to retain a panel thickness therebetween;

said slots being cut to a vertical depth equal to one-half the vertical height of the ends of said tie means, such that said tie ends completely fill the vertical depth of abutting slots in vertically abutting panels, thereby interlocking the panels;

said slots in the lower edge of the lowermost tier of panels in said walls being cut to a vertical depth equal to the vertical height of the ends of said tie means;

said slots in the upper edge of the uppermost tier of panels in said walls being cut to a vertical depth equal to the vertical height of the ends of said tie means;

said tie ends completely filling the vertical depth of said slots in the lower edge of the lowermost tier of panels and said slots in the upper edge of the uppermost tier of panels, such that said lower and upper edges are free of protruding ties;

a first tie end of said ties being mounted in said tie slots between vertically abutting first panels with said outer paddle disposed outwardly of the outer surface of said first panels, said inner paddle disposed inwardly of the inner surface of said first panels, at least one leg between said paddles being retained in a slot in the lower edge of an upper, vertically abutting first panel and at least one leg between said paddles being retained in a slot in the upper edge of a lower, vertically abutting first panel, to interlock said vertically abutting first panels;

and second tie ends of said ties being mounted in said tie slots between vertically abutting second panels to interlock said second panels vertically and parallel to said first panels;

said legs between said inner and outer paddles of said first tie end being of a material adapted to be easily broken by a sharp vertical blow to said outer paddle, such that said first panels may be removed from a hardened concrete wall formed between said first and second vertical walls, said diverging legs of said first tie end also being of a material adapted to be easily broken by a sharp vertical blow to said inner paddle, such that said first wall may be removed from a hardened concrete wall formed between said first and second walls, leaving at least one side of said concrete wall exposed, by removing first tie end outer paddles, said first panels, and said first tie and inner paddles; and end panel means at each end of said parallel walls for retaining concrete between said walls and said end panels for forming a concrete wall.

10. A concrete forming system, comprising:

first and second parallel and spaced-apart walls;

said first wall comprised of a series of first polystyrene panels stacked on top of one another;

said second wall comprised of a series of second polystyrene panels stacked on top of one another;

said first and second panels having an inwardly-disposed surface, an outwardly-disposed surface, upper and lower edges, and vertical side edges;

vertical tie slots in said upper and lower edges of said first and second panels, spaced equidistant horizontally on every panel such that vertically abutting panels have slots which abut in vertical alignment;

a plurality of independent, elongated tie means each having first and second longitudinal ends, each said end being engaged in a pair of said vertically abutting tie slots for interlocking vertically abutting panels in vertical engagement with one another and for interlocking said first panels in said first wall with said second panels in said second wall in parallel, spaced-apart relation, said tie means being spaced-apart vertically and horizontally;

said tie slots in said panels being single vertical slots cut completely through the thickness of said panels perpendicularly to the inner and outer surfaces such that said tie ends extend completely therethrough;

said tie ends engaged with said slots;

each said tie means including:

an elongated strap having a pair of diverging legs at each end;

said diverging legs at each end of said strap having an inner and outer paddle member connected thereto;

said inner and outer paddle members mounted perpendicularly to said strap;

and at least two leg members mounted between said inner and outer paddle members at each strap end, affixing said inner and outer paddles in spaced-apart, parallel relation at a distance to retain a panel thickness therebetween;

said slots being cut to a vertical depth equal to one-half the vertical height of the ends of said tie means, such that said tie ends completely fill the vertical depth of abutting slots in vertically abutting panels, thereby interlocking the panels;

said slots in the lower edge of the lowermost tier of panels in said walls being cut to a vertical depth equal to the vertical height of the ends of said tie means;

said slots in the upper edge of the uppermost tier of panels in said walls being cut to a vertical depth equal to the vertical height of the ends of said tie means;

said tie ends completely filling the vertical depth of said slots in the lower edge of the lowermost tier of panels and said slots in the upper edge of the uppermost tier of panels such that said lower and upper edges are free of protruding ties;

each said tie means including first and second tie means, said outer paddle member on said second tie end connected to said leg members to form a T-shaped end;

at least said second panels having slots cut along said upper and lower edges and intersecting said tie slots to form crossed-slots at each tie slot;

said second tie ends of said ties being mounted in said crossed-slots and tie slots between vertically abutting second panels with said outer paddle retained in said crossed-slots in the lower edge of an upper abutting second panel and in the upper edge of a lower abutting second panel, one of said legs between said inner and outer paddles of said second tie end being retained within the tie slots of the upper edge of the lower second panel of the abutting second panels and another leg being retained within the lower slot in the lower edge of the upper abutting second panel, to interlock said upper and lower vertically abutting second panels;

said first tie ends of said ties being mounted in said tie slots between vertically abutting first panels to interlock said first panels vertically and parallel to said second panels;

said second tie ends being permanently secured in embedded position in said second panels to permanently retain said second panels in position when concrete is poured and hardened between said vertically oriented first and second parallel walls to thereby provide a concrete wall with insulated panels permanently attached to at least one exterior side of said concrete wall; and end panel means at each end of said parallel walls for retaining concrete between said walls and said end panels for forming a concrete wall.

11. A concrete forming system, comprising:

a pair of parallel walls, each comprised of a series of polystyrene panels stacked on top of one another;

said panels having an inwardly disposed surface, an outwardly disposed surface, upper and lower edges, and vertical opposite side edges;

vertical tie slots in said upper and lower edges of said first and second panels, spaced equidistant horizontally on every panel such that vertically abutting panels have slots which abut in vertical alignment;

tie means engaged in said tie slots for interlocking vertically abutting panels in vertical engagement with one another and for interlocking opposingly disposed panels of said parallel walls in parallel, spaced-apart relation; and each said tie means including: an elongated strap having at least two spaced-apart legs at each end;

said legs at each end of said strap having an inner and outer paddle member connected thereto;

said inner and outer paddle members mounted perpendicularly to said strap; and at least two leg members mounted between said inner and outer paddle members at each strap end, affixing said inner and outer paddles in spaced-apart, parallel relation at a distance to retain a panel thickness therebetween.

* * * * *